US007616165B2

(12) United States Patent
Tammisetti et al.

(10) Patent No.: US 7,616,165 B2
(45) Date of Patent: Nov. 10, 2009

(54) MULTIPLE BAND ANTENNA ARRANGEMENT

(75) Inventors: Mohan R. Tammisetti, South Riding, VA (US); Ajay Gupta, Oakton, VA (US); Jihad Hermes, Herndon, VA (US)

(73) Assignee: Nextel Communications, Inc., Reston, VA (US)

( * ) Notice: Subject to any disclaimer, the term of this patent is extended or adjusted under 35 U.S.C. 154(b) by 246 days.

(21) Appl. No.: 11/508,165

(22) Filed: Aug. 23, 2006

(65) Prior Publication Data

US 2008/0048923 A1 Feb. 28, 2008

(51) Int. Cl.
*H01Q 13/00* (2006.01)

(52) U.S. Cl. ..... 343/786; 343/776

(58) Field of Classification Search ..... 343/757, 343/765, 776, 786
See application file for complete search history.

(56) References Cited

U.S. PATENT DOCUMENTS 3,611,396 A * 10/1971 Jones, Jr. ..... 343/776
5,327,147 A * 7/1994 Caille et al. ..... 343/700 MS
5,488,380 A 1/1996 Harvey et al.
5,936,591 A * 8/1999 Yamasa et al. ..... 343/853
6,218,999 B1 * 4/2001 Bousquet et al. ..... 343/765
6,272,120 B1 8/2001 Alexander
6,486,845 B2 * 11/2002 Ogawa et al. ..... 343/765
6,657,589 B2 12/2003 Wang et al.
6,816,706 B1 11/2004 Hohnstein et al.
7,453,404 B2 * 11/2008 Ying ..... 343/702
2007/0008236 A1 * 1/2007 Tillery et al. ..... 343/797
2007/0241979 A1 * 10/2007 Yang ..... 343/765
2007/0285329 A1 * 12/2007 Flynn et al. ..... 343/786
2008/0030419 A1 * 2/2008 Sjoblom ..... 343/853

OTHER PUBLICATIONS

International Search Report and Written Opinion for PCT/US2007/17803 dated Feb. 27, 2008.

* cited by examiner

*Primary Examiner*—Tan Ho

(57) ABSTRACT

Antenna arrangements that include two or more antennas in an enclosure are provided. Each of these antennas can be tuned to a separate frequency band and/or can support a different wireless communication technology. The downtilt of the antennas can be electrically and/or mechanically controlled, and various feeder arrangements can be employed.

14 Claims, 9 Drawing Sheets

100

200

MULTIPLE BAND ANTENNA ARRANGEMENT

BACKGROUND OF THE INVENTION

Due to local government restrictions, instead of building individual towers for each individual operator's use, different wireless network operators typically co-locate their equipment at a single network tower. This has resulted in the rise of so-called "tower companies" that own wireless network towers and lease space on the towers to different wireless network operators. This arrangement requires a wireless network operator to negotiate a lease agreement if it is desired to add antennas or cable runs between existing antennas and a backhaul network.

In some cases a wireless network operator is willing to pay for additional antennas, but due to regulatory wind-loading limits, a tower company cannot allow additional antennas on a particular tower.

SUMMARY OF THE INVENTION

Due to federal government regulations, a wireless network operator was typically allocated one frequency band for any particular geographic area. In some cases a wireless network operator may be allocated two frequency bands, which are located relatively close to each other, e.g., 800 and 900 MHz frequency bands. For closely located frequency bands, a single antenna can be provided to support both frequency bands. Accordingly, in these cases a wireless network operator need only deploy one type of antenna, i.e., one that supports the allocated frequency band for the particular geographic area.

Recently some wireless network operators have been allocated two or more frequency bands for a particular geographic area. These frequency bands may be separated by several hundred, or even thousand, megahertz in the frequency domain. In such systems a single antenna may not be able to support both frequency bands.

In accordance with exemplary embodiments of the present invention, an antenna arrangement is provided. The antenna arrangement includes an antenna enclosure and first and second antennas arranged inside of this enclosure. The first antenna can be arranged to support a first frequency band and the second antenna can be arranged to support a second, different, frequency band. Accordingly, a single antenna enclosure can be provided for supporting different frequency bands, thereby reducing a network operator's costs for leasing space on wireless towers.

Other objects, advantages and novel features of the present invention will become apparent from the following detailed description of the invention when considered in conjunction with the accompanying drawings.

BRIEF DESCRIPTION OF THE DRAWING FIGURES

DETAILED DESCRIPTION OF THE PREFERRED EMBODIMENTS

Figure 1:
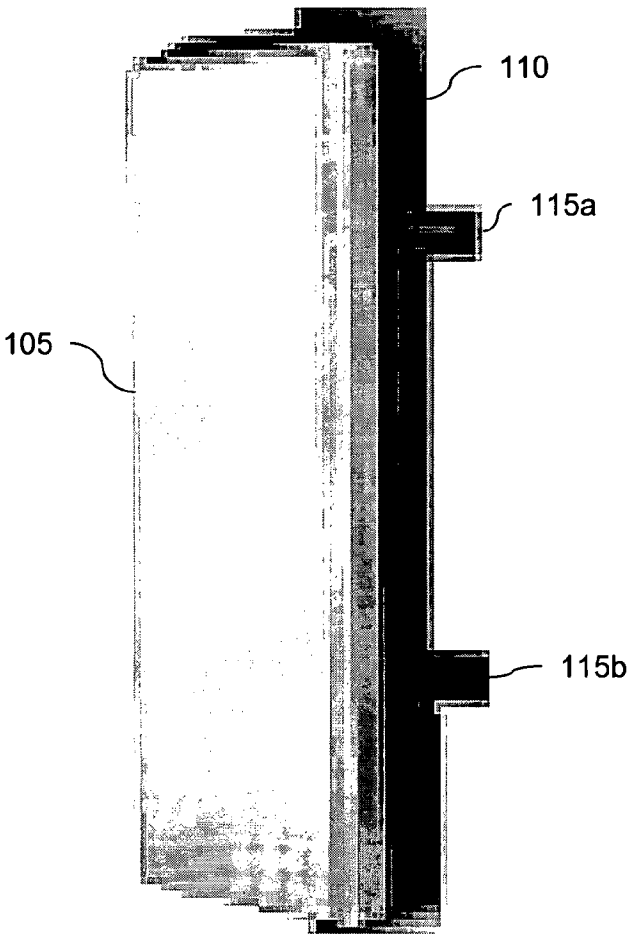
FIG. 1 illustrates a side view of an exemplary antenna arrangement in accordance with exemplary embodiments of the present invention.

FIG. 1 illustrates a side view of an exemplary antenna arrangement in accordance with exemplary embodiments of the present invention. The antenna arrangement 100 includes an antenna enclosure 105 coupled to supporting structure 110. Supporting structure 110 includes attachment mechanisms 115*a* and 115*b*. Attachment mechanisms 115*a* and 115*b* can be any type of mechanism for attaching the antenna arrangement to a antenna tower, such as, for example, suction cups.

Figure 2:
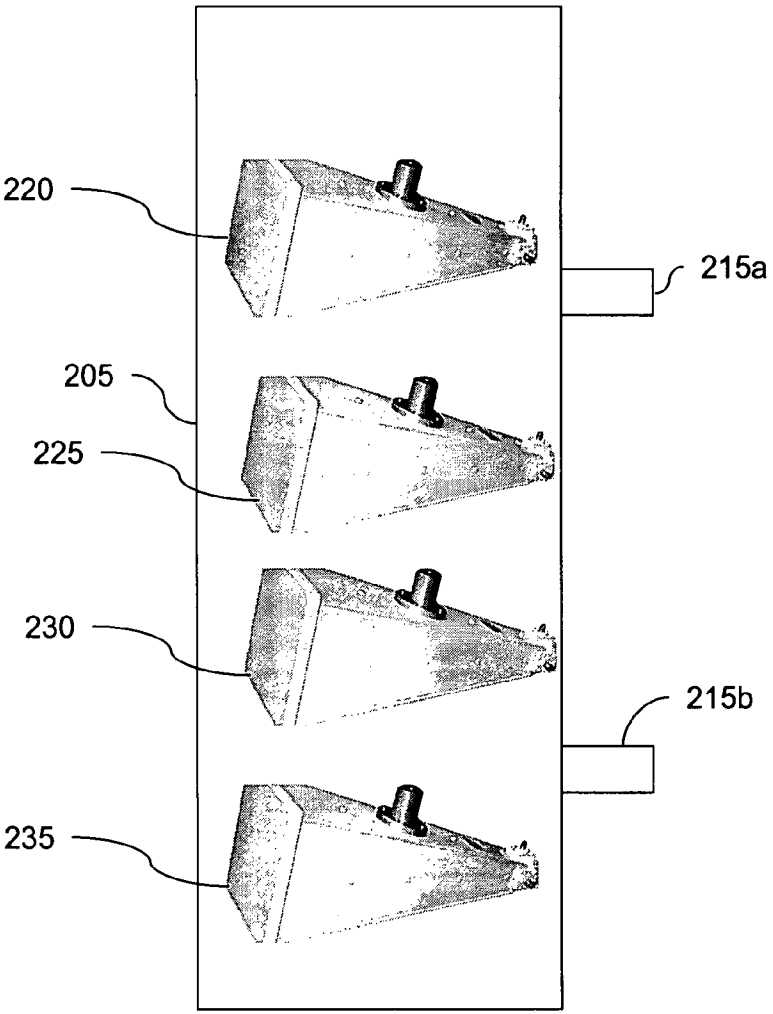
FIG. 2 illustrates a cross-section of an exemplary antenna arrangement in accordance with one aspect of the present invention.

FIG. 2 illustrates a cross-section of an exemplary antenna arrangement in accordance with one aspect of the present invention. Antenna arrangement 200 includes an enclosure 205 coupled to attachment mechanisms 215*a* and 215*b*. A plurality of horn antennas 220-235 are arranged inside of enclosure 205. These horn antennas can be composed of a block of foam with corrugated metal arranged in-line with the horn. The corrugated metal is a thin, electrically conductive layer, deposited on the inner surface of each horn antenna. This composition allows each of the horn antennas to be lightweight, small in volume, yet sturdy. In some embodiments the foam can be polymer foam. Each of these horn antennas can be arranged to support communications over different frequency bands and/or support different wireless communication technologies. For example, horn antenna 220 can be arranged to communicate over an 800/900 MHz frequency band (i.e., it is tuned to this frequency band), horn antenna 225 can be arranged to communicate over a 1900 MHz frequency band, horn antenna 230 can be arranged to communicate over a 2.5 GHz frequency band and horn antenna 235 can be arranged to communicate over a 24 GHz frequency band.

Figure 3:
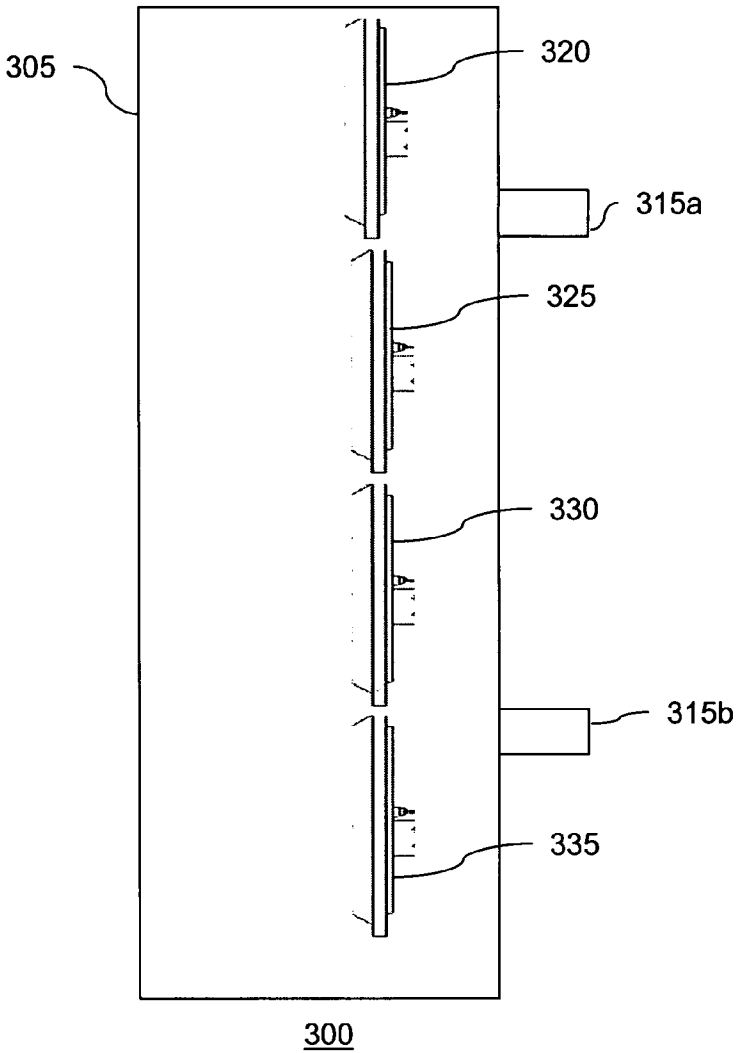
FIG. 3 illustrates a cross-section of an exemplary antenna arrangement in accordance with another aspect of the present invention.

FIG. 3 illustrates a cross-section of an exemplary antenna arrangement in accordance with another aspect of the present invention. Antenna arrangement 300 includes an enclosure 305 coupled to attachment mechanisms 315*a* and 315*b*. Inside of enclosure 305 are a panel antenna 320 and plurality of planar antenna arrays 325-335. The panel antenna 320 can be arranged to support communications over the 800, 900 and 1900 MHz frequency bands. Each of the planar antenna arrays 325-335 can be arranged to support communications over different frequency bands for different types of communication services. For example, planar antenna array 325 can be arranged to communicate over an unlicensed portion of the 24 GHz frequency band, planar antenna array 330 can be arranged to communicate in accordance with local multipoint distribution service (LMDS), E-Band and/or digital electronic messaging service (DEMS).

The following table illustrates various unlicensed frequency bands that can be used for antennas of the present invention:

| | ISM-2.4 | UNII Indoor | UNII Low Power | UNII/ ISM | UNII (*) | 24 GHz | 60 GHz |
|---|---|---|---|---|---|---|---|
| Frequency Range [GHz] | 2.4-2.4835 | 5.15-5.25 | 5.25-5.35 | 5.725-5.825 | 5.47-5.725 | 24-24.25 | 61-61.5 |
| Bandwidth | 83.5 MHz | 100 MHz | 100 MHz | 100 MHz | 255 MHz | 250 MHz | 500 MHz |
| Max Power | 1 W(1) | 50 mW | 250 mW | 1 W | 250 mW | N/A(4) | 500 mW |
| Max EIRP | 4 W(2) | 200 mW(2) | 1 W(2) | 200 W(3) | 1 W(2) | N/A(4) | 20 W |

The 24.0 to 24.250 GHz portion of the 24 GHz band is a recent addition to the unlicensed spectrum resource that is available. In accordance with exemplary embodiments of the present invention, this frequency band can be employed for point-to-point backhaul applications. The 24 GHz frequency band allows the use of relatively small antennas (i.e., 1 and 2 foot) which can simultaneously provide very high spatial filtering of interference. Additional rejection of interference is achieved because 24 GHz signals do not pass through building materials or foliage. The combination of these attributes allows highly robust, dependable operation. The 24 GHz band transmitters are relatively low power, thereby limiting operating ranges to typically 2 to 4 miles and provides higher data rates, however, low power functionality also tends to facilitate lower cost products.

The following table is the FCC Common Carrier Spectrum for point-to-point (PTP) link systems that can be employed by the antennas of the present invention:

| Frequency Band [GHz] | Max EIRP [dBm] |
|---|---|
| 5.9-7.1 | 85 |
| 10.5-10.7 | 85 |
| 10.7-11.7 | 85 |
| 17.7-19.7 | 85 |
| 21.2-23.6 | 85 (55 for 21.8-22.0 and 23.0-23.2) |

The following table summarizes the LMDS & DEMS frequency bands that can be employed by the antennas of the present invention:

| Frequency Band [GHz] | Max EIRP [dBm] | Service Description |
|---|---|---|
| 24.250-25.450 | 85 | DEMS: The band includes 5 × 40 MHz FDD channels with 800 MHz spacing |
| 28 | 85 (27,500 to 28,350) 30 dBW/MHz (31,000 to 31,075 & 31,075 to 31,225 & 31,225 to 31,300) | LMDS: Two spectrum blocks: Block A is 1,150 MHz in three parts: 27.5-28.35 GHz, 29.10-29.250 GHz, and 31.075-31.225 GHz; Block B is 150 MHz in two parts; 31.0-31.075 and 31.225-31.3 GHz |
| 38 | 85 | 50 MHz FDD paired channels at 38.6-38.95 GHz and at 39.3-39.65 GHz. |

The E-Band is another frequency band that can be employed by the antennas of the present invention. This frequency band includes 71-76 GHz, 81-86 GHz and 92 to 95 GHz, and generally systems that operate in the 70/80 GHz range are referred to as E-Band systems.

Figure 4:
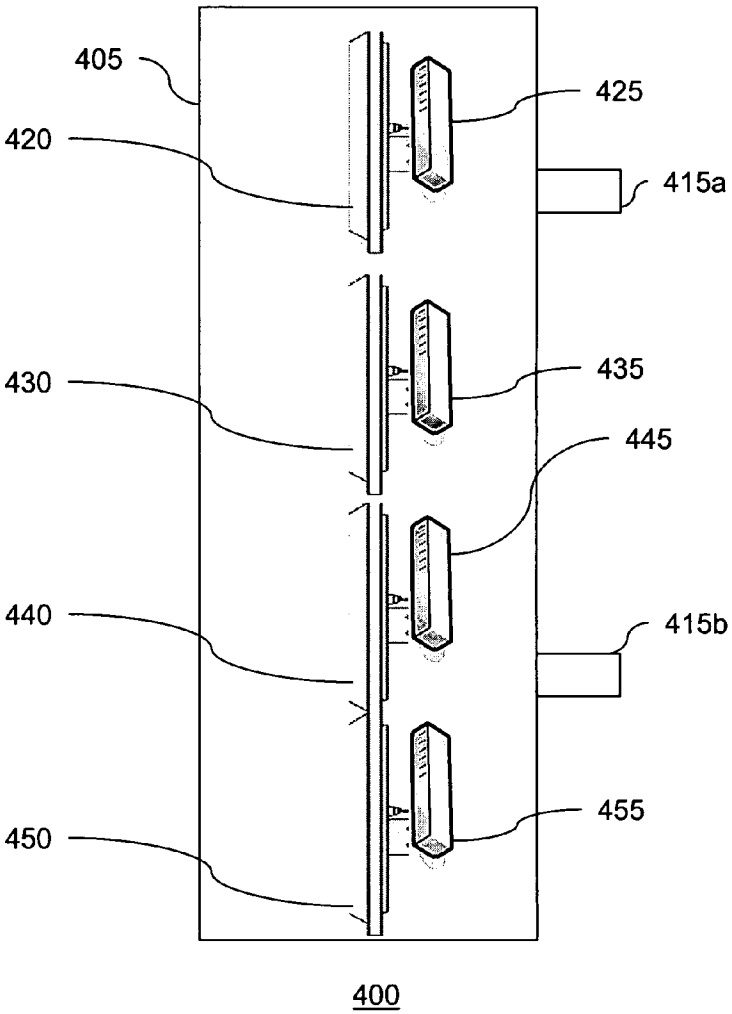
FIG. 4 illustrates a cross-section of an exemplary antenna arrangement in accordance with yet another aspect of the present invention.

FIG. 4 illustrates a cross-section of an exemplary antenna arrangement in accordance with yet another aspect of the present invention. The antenna arrangement of FIG. 4 is similar to that of FIG. 3, with the addition of radios 425, 435, 445 and 455. Specifically, inside of enclosure 405 are a panel antenna 420, a plurality of planar antenna arrays 420, 430, 440, 450, and a plurality of radios 425, 435, 445 and 455. The panel antenna 420 can be arranged to support communications over the 800, 900 and 1900 MHz frequency bands. Each of the planar antenna arrays 420, 430, 440, 450, can be arranged to support communications over different frequency bands for different types of communication services. As illustrated in FIG. 4, each antenna is electrically coupled to a corresponding radio. Specifically, antenna 420 is coupled to radio 425, antenna 430 is coupled to radio 435, antenna 440 is coupled to radio 445, and antenna 450 is coupled to radio 455.

FIGS. 5*a*-5*e* illustrate cross-sections of exemplary antenna arrangements in accordance with the present invention. These antenna arrangements are similar to those described above in connection with FIGS. 1-4, but are simplified to highlight additional aspects of the present invention. Accordingly, although these figures illustrate an antenna arrangement with two antennas, these antenna arrangements can include more than two antennas.

Figure 5A:
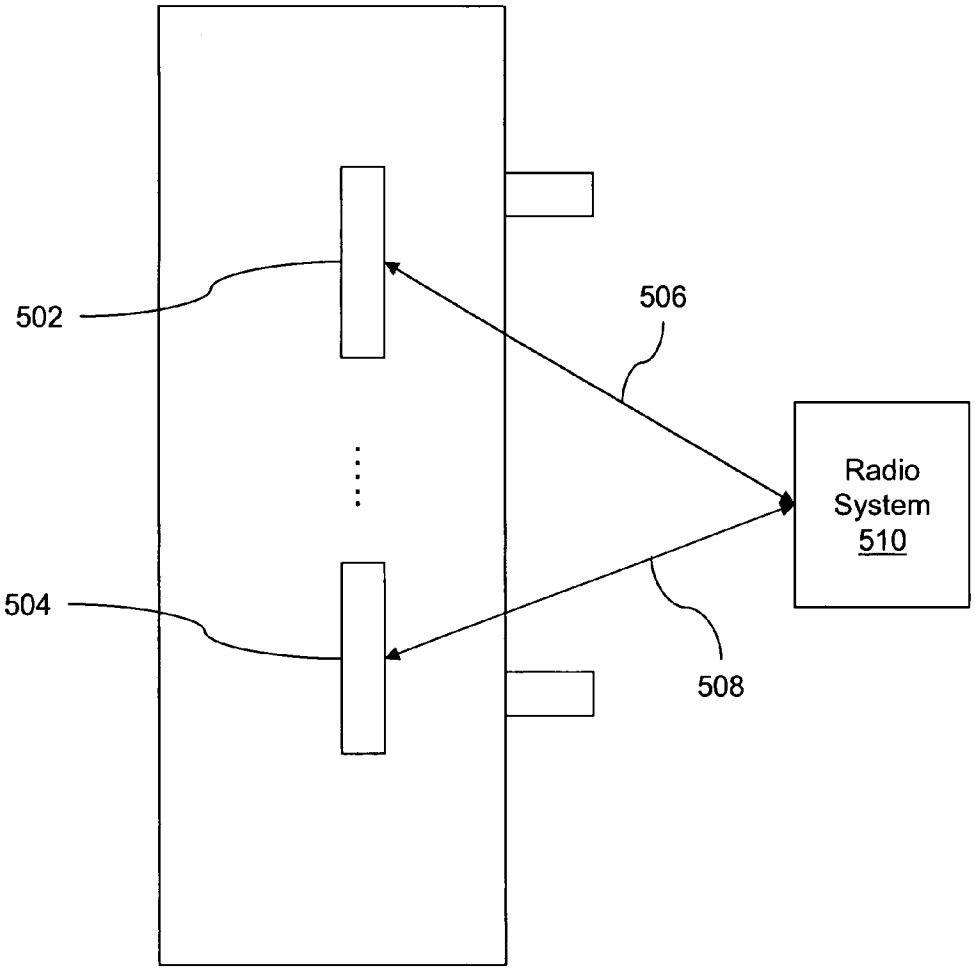
FIGS. 5*a*-5*e* illustrate cross-sections of exemplary antenna arrangements in accordance with the present invention.

The antenna arrangement of FIG. 5*a* includes antennas 502 and 504, and radio system 510. Accordingly, when the radios are not located within the antenna arrangement as illustrated in FIG. 4, each antenna can be coupled to radio system 510 via a separate feeder cable. Specifically, antenna 502 is coupled to radio system 510 via feeder cable 506, and antenna 504 is coupled to radio system 510 via feeder cable 508. Radio system 510 can include one or more radios for supporting each or both of antennas 502 and 504.

Figure 5B:
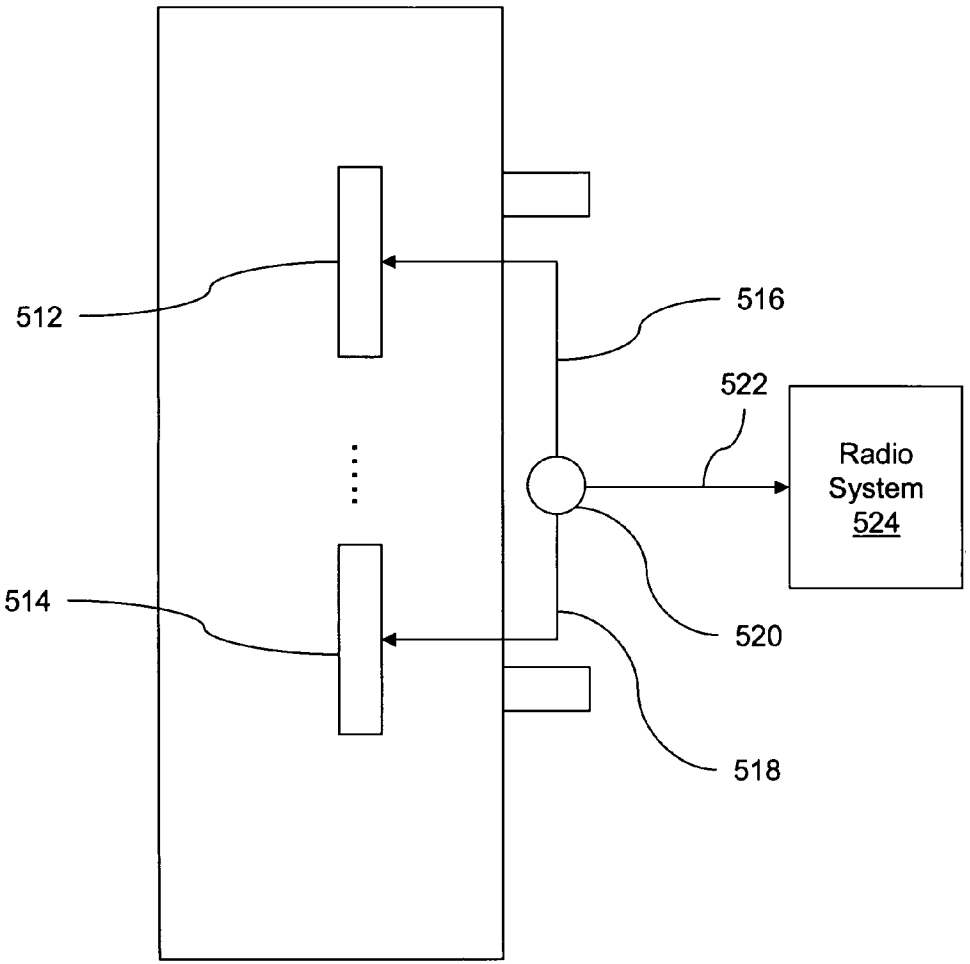

FIG. 5*b* illustrates an alternate arrangement to that of FIG. 5*b*. Instead of employing individual feeder cables between the antennas and radio system, the arrangement in FIG. 5*b* combines a number of feeder cables for a number of antennas. Accordingly, signals from antenna 512 are provided via feeder cable 516 to combiner 520, and similarly, signals from antenna 514 are provided via feeder cable 518 to combiner 520. Combiner 520 combines the signals from antennas 512 and 514 and then forwards the signals to radio system 524 via feeder cable 522. Combiner 520 can act as a splitter for signals from radio system 524 to antennas 512 and 514, such that signals from feeder cable 522 are appropriately routed to feeder cables 516 and 518. Feeder cables 516, 518 and 522 can be any type of feeder cables. For example, feeder cables 516 and 518 can carry radio frequency signals and feeder cable 522 can carry optical signals (i.e., it can be an fiber optic cable). Although FIG. 5*b* illustrates combiner 520 located outside of the enclosure, the combiner can be located inside of the enclosure.

Figure 5C:
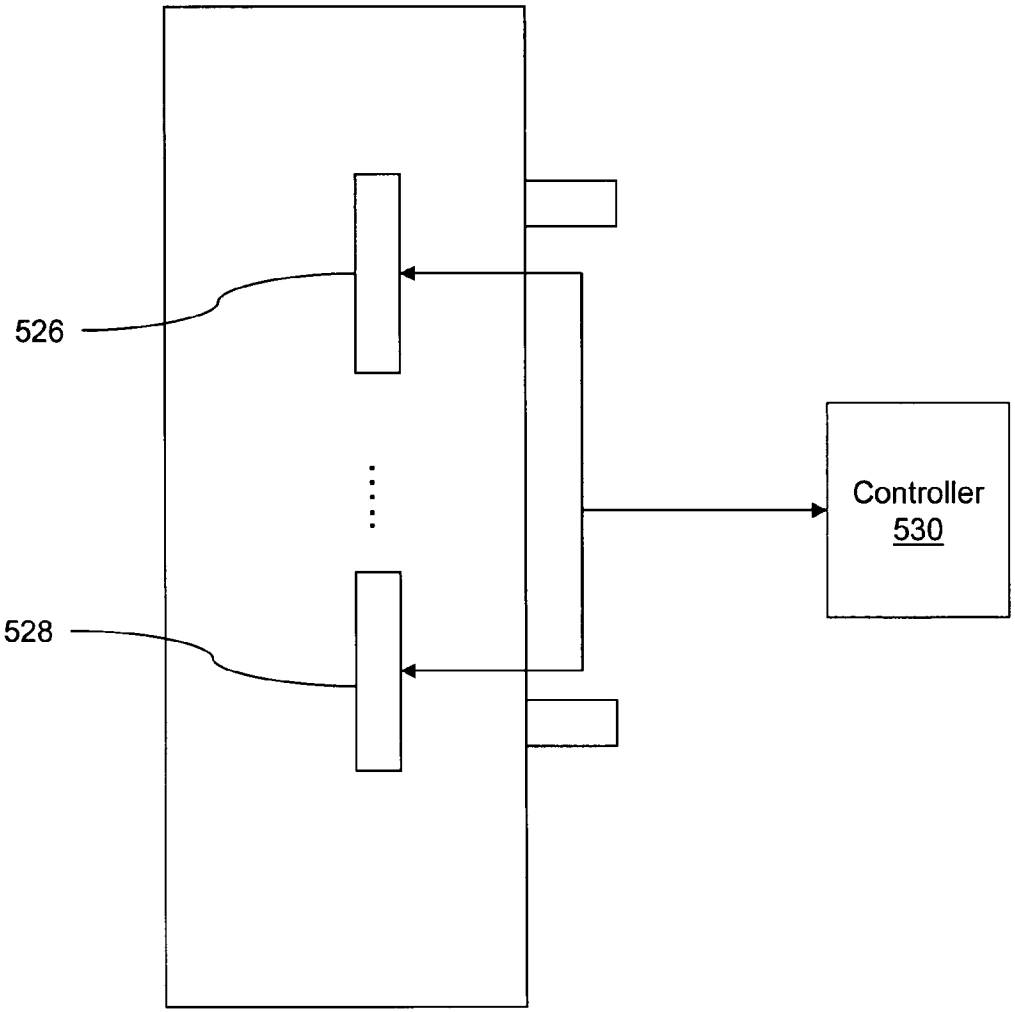
Figure 5D:
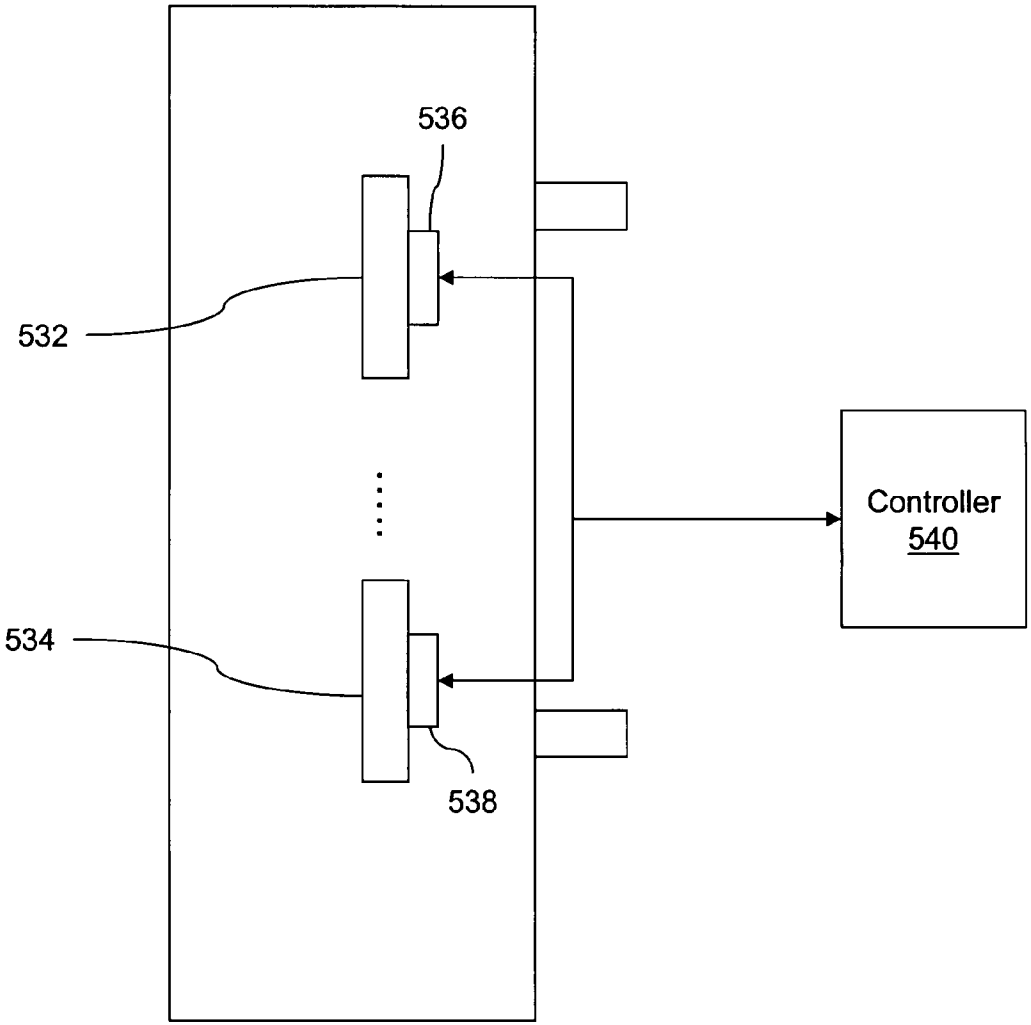
Figure 5E:
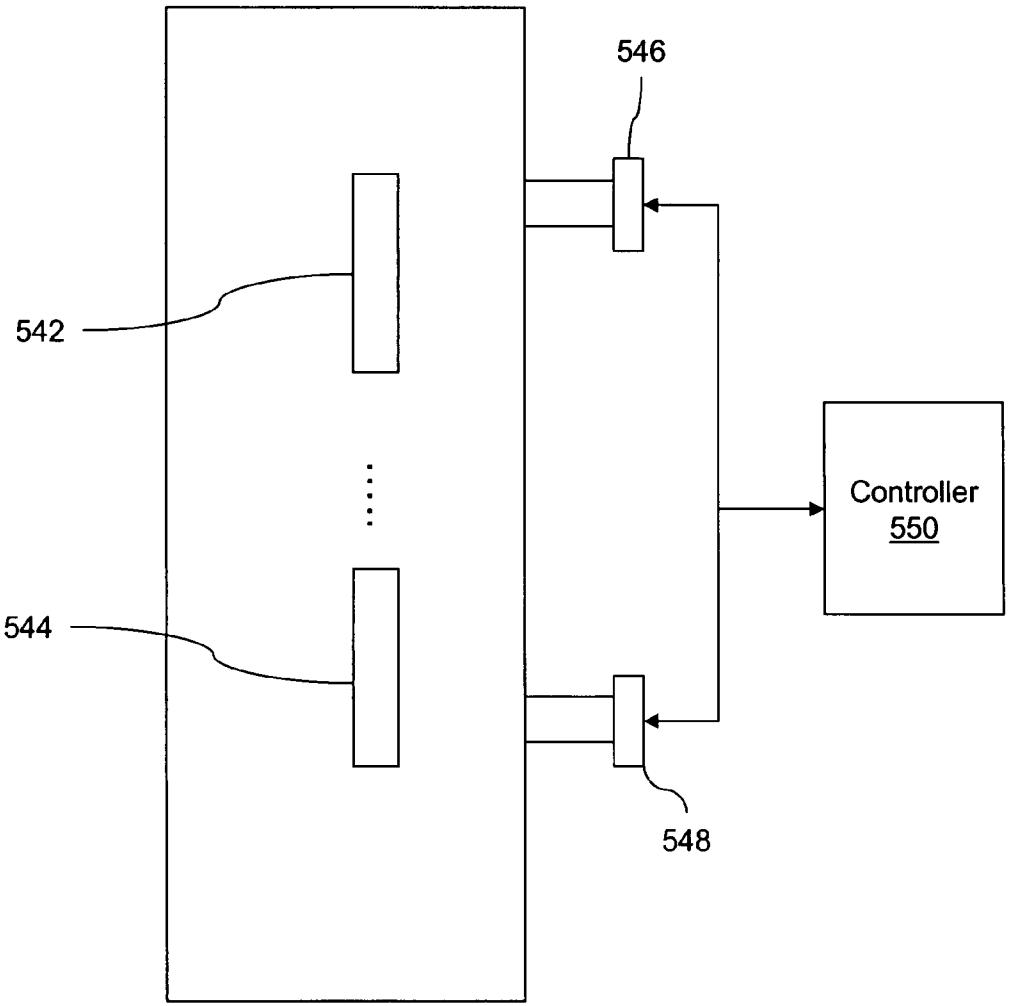

FIGS. 5*c*-5*e* illustrate exemplary arrangements for adjust the downtilt of antennas in an antenna arrangement in accordance with exemplary embodiments of the present invention. In the arrangement of FIG. 5*c*, the downtilt of antennas 526 and 528 can be electrically controller using controller 530. In FIG. 5*d* antenna 532 is coupled to a mechanical tilt mechanism 536 and antenna 534 is coupled to a mechanical tilt mechanism 538. Controller 540 controls the downtilt of antenna 532 by sending signals to tilt mechanism 536 and the downtilt of antenna 534 by sending signals to tilt mechanism 538. Accordingly, the amount of downtilt of each antenna in the antenna arrangement can be individually made. In FIG. 5*e* the enclosure include mechanical tilt mechanisms 546 and 548. Accordingly, the downtilt of all of the antennas can be controlled by controller 550 using either or both of these tilt mechanisms. Controllers 530, 540 and 550 of FIGS. 5*c*-5*e* can include a processor and/or memory. The processor can be any type of processor including a microprocessor, field programmable gate array (FPGA), and/or application specific integrated circuit (ASIC).

Although the features of FIGS. 5*c*-5*e* have been described individually, they can be combined in any manner. For example, the feeder cable arrangement of FIG. 5*a* can employ any or all of the downtilt control arrangements of FIGS. 5*c*-5*e*, and the feeder cable arrangement can employ any or all of the downtilt control arrangements of FIGS. 5*c*-5*e*. Similarly, an antenna arrangement can include one or more of the downtilt control arrangements of FIGS. 5*c*-5*e*.

In the antenna arrangement of the present invention very high impedance feeder cables can be employed to provide high port isolation. When minimization of the size of the antenna elements is desired moderate line width feeder cables can be employed. In order to maximize antenna gain, impedance matching, and losses within and outside the antenna should be accounted for.

The antenna elements should be arranged inside of the enclosure to minimize the interaction between the antenna array elements and its surroundings inside the enclosure. By limiting interactions between an antenna element and its surroundings, antenna isolation is achieved which provides good performance and efficiency. In particular, integrated multiband antenna radiating elements should be highly isolated to limit such interactions. By shaping an antenna element's near field pattern away from absorbers, a good radiation pattern of an isolated antenna can be achieved and efficiency can be improved. Coupling between the different antennas in the same enclosure should account for the overall radiation pattern requirements. By employing side lobe suppression optimum beamwidth side lobe performance can be achieved.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An antenna arrangement comprising:

an antenna enclosure;

a first antenna tuned for a first frequency band;

a second antenna tuned for a second frequency band, the first and second frequency bands being non-coextensive;

a first mechanical tilting mechanism coupled to the first antenna; and a second mechanical tilting mechanism coupled to the second antenna wherein the first and second antennas are arranged inside of the antenna enclosure, wherein the first and second antennas are coupled to a controller, wherein the first and second mechanical tilting mechanisms are coupled to the controller, and the controller controls tilting of the first and second antennas via the respective first and second mechanical tilting mechanisms.

2. The antenna arrangement of claim 1, wherein the first and second antennas are horn antennas.

3. The antenna arrangement of claim 1, wherein the second antenna is also tuned for a third frequency band.

4. The antenna arrangement of claim 3, wherein the second frequency band is a 800 MHz frequency band and the third frequency band is a 900 MHz frequency band.

5. The antenna arrangement of claim 4, wherein the first frequency band is a 2.5 GHz frequency band.

6. The antenna arrangement of claim 1, further comprising:

a third antenna, arranged inside of the enclosure, tuned to a third frequency band.

7. The antenna arrangement of claim 1, wherein the first and second antennas are composed of a composition of foam and corrugated metal.

8. The antenna arrangement of claim 7, wherein the foam is a polymer foam.

9. The antenna arrangement of claim 1, wherein the first and second antennas are planar antennas.

10. The antenna arrangement of claim 1, wherein the controller also controls an electrical downtilt of the first and second antennas.

11. The antenna arrangement of claim 1, further comprising:

a first radio coupled to the first antenna; and a second radio coupled to the second antenna.

12. The antenna arrangement of claim 11, wherein the first and second radios are arranged inside of the antenna enclosure.

13. The antenna arrangement of claim 12, further comprising:

a combiner;

a first cable coupling the first antenna to the first radio via the combiner; and a second cable coupling the second antenna to the second radio via the combiner.

14. An antenna arrangement comprising:

an antenna enclosure;

a first antenna tuned for a first frequency band; and a second antenna tuned for a second frequency band, the first and second frequency bands being non-coextensive, a first mechanical tilting mechanism coupled to the first antenna; and a second mechanical tilting mechanism coupled to the second antenna, wherein the first and second antennas are arranged inside of the antenna enclosure, wherein the first and second mechanical tilting mechanisms are coupled to a controller, and the controller controls tilting of the first and second antennas via the respective first and second mechanical tilting mechanisms;

wherein the first antenna is arranged for communicating with remote stations and the second antenna is arranged for providing a backhaul to a wireless communication network infrastructure.

* * * * *